United States Patent [19]

Reinert et al.

[11] 4,031,273

[45] June 21, 1977

[54] CONTINUOUS PROCESS FOR OPTICAL BRIGHTENING

[75] Inventors: Gerhard Reinert, Allschwil, Switzerland; Jack Fallows, Shaw Oldham, England; Paul Dussy, Basel, Switzerland

[73] Assignee: Ciba-Geigy Corporation, Ardsley, N.Y.

[22] Filed: Aug. 25, 1975

[21] Appl. No.: 607,398

[30] Foreign Application Priority Data

Sept. 3, 1974 Switzerland ..... 11947/74

[52] U.S. Cl. ..... 427/158; 8/1 W

[51] Int. Cl.[2] ..... D06M 1/14; D06M 1/22

[58] Field of Search ..... 8/1 W, 169, 92, 93, 8/94 A; 427/158; 252/301.21

[56] References Cited

FOREIGN PATENTS OR APPLICATIONS

| | | |
|---|---|---|
| 1,300,489 | 6/1962 | France |
| 1,147,964 | 4/1969 | United Kingdom |
| 1,275,162 | 5/1972 | United Kingdom |
| 1,307,532 | 2/1973 | United Kingdom |

OTHER PUBLICATIONS

Reinert, G., "Reinigen, Austusten und Aufhellen aus organischen Losungamittela," in *Textilvenedlung* 10(3), pp. 85–91, Mar. 1925.

*Primary Examiner*—James R. Hoffman
*Attorney, Agent, or Firm*—Karl F. Jorda; Edward McC. Roberts; Prabodh I. Almaula

[57] ABSTRACT

Process for the continuous optical brightening of synthetic polyamide fibre material from organic solvents, wherein a. the fibre material is dry cleaned,
b. at least one ionic optical brightener is applied to the material from a solution, emulsion or dispersion in a non-polar organic solvent,
c. the material is intermediately dried,
d. the optical brightener is developed in a hot aqueous acid bath, and
e. the fibre material is subsequently thermofixed.

14 Claims, No Drawings

CONTINUOUS PROCESS FOR OPTICAL BRIGHTENING

The present invention relates to a continuous process for optically brightening organic fiber materials made from synthetic polyamide from organic solvents, as well as to the polyamide material optically brightened by this process.

Attempts have been made in recent years, in connection with the problem of waste-liquor, to replace the water in finishing processes entirely or partially with organic solvents, which can be recovered. Particular preference is given to perchloroethylene (tetrachloroethylene), since it is relatively cheap, noncombustible and readily obtainable, and since moreover it has other technical advantages, such as, e.g. the possibility of process integration, e.g. the combination of a dry cleaning with the application of the brightener. Furthermore, the energy requirement in the case of operating in perchloroethylene is substantially reduced; theoretically, there are required for drying 1 kg of textile material containing 100% of water 619 kcal. But if the material contains 160% of perchloroethylene (perchloroethylene is 1.6 times denser than water), only 114 kcal are required, which corresponds to a heat-quantity ratio of 1:5.5.

Efforts have been directed towards using these advantages also for the continuous application of optical brighteners; however, in the optical brightening of synthetic polyamide fiber materials particular problems have been encountered.

Considered in general, ionic and nonionic brighteners are suitable for optically brightening polyamide fiber materials. Nonionic products as a rule produce effects having a high standard of fastness; these products however are at present clearly inferior to ionic brighteners with respect to maximum white and to brilliance.

With regard to the aqueous continuous use of nonionic and ionic brighteners, there is usually no problem in the case of nonionic products. These products can be developed by dry heat (thermofixing) without difficulties. The ionic products, however, cannot be thermofixed, or can be only inadequately thermofixed, without the use of developing auxiliaries.

The developing auxiliaries used for the continuous aqueous application are as a rule polyethylene glycols. Even with application from non-polar organic solvents, it has not been hitherto possible to thermofix, or to adequately thermofix, ionic brighteners. The use of polyethylene glycols as developing auxiliaries is not possible since they are not soluble in perchloroethylene and cannot be used in the emulsion. That is moreover the reason why polyamide fibers even today are in many cases brightened discontinuously.

The continuous application of ionic optical brighteners to polyamide is limited also because of the fact that the developing capacity of the ionic optical brighteners on polyamide is governed by the chemical synthesis and origin of the fibers. As a rule, the ionic optical brightener can be developed by means of dry heat more easily on polyamide-6 than on polyamide-6,6; the degree of development is however seldom complete.

In order to develop these ionic optical brighteners and to thus attain a maximum degree of whiteness, it is already known to treat the brightened material with steam before or after passage through the tentering dryer.

In the textile industry, the application of wet heat (steaming with steam) for the continuous development of optical brightenings on polyamide can however in general be carried out only in the printing works, since special apparatus is required for the purpose.

Also to be mentioned is the fact that heat fixing in the case of polyamide articles, e.g. with textured polyamide, is not generally applicable. It can lead to a damaging of the texturing on sensitive polyamide articles.

A process has not been found which renders possible the continuous brightening of synthetic polyamide materials with ionic optical brighteners from non-polar organic solvents, particularly from perchloroethylene, with excellent degrees of whiteness, e.g. on continuous scouring machines with an application arrangement, whereby the preliminary scouring of the material can be carried out optionally with an application of brightener as an integrated process. The two processing stages of cleansing from solvents and application of the brightener together with drying can therefore be performed in a single operation.

This single-stage procedure is rendered possible by the excellent wetting and penetration properties of the non-polar organic solvents used for the application process, in consequence of which the operating speed of the machines is high with, at the same time, a perfectly level finish of the optically brightened material being obtained.

Since the non-polar solvent, e.g. perhchloroethylene, does not swell the fibers and, moreoever, can be removed by suction to a high degree, the process is performed with a degree of certainty which can not be ensured with the use of water as the treatment agent.

The process according to the invention is thus one in which a. the fiber material is dry cleaned,
b. at least one ionic optical brightener is applied to the material from a solution, emulsion or dispersion in a non-polar organic solvent,
c. the material is intermediately dried,
d. the optical brightener is developed in a hot aqueous acid bath, and
e. the fiber material is subsequently thermofixed.

Suitable synthetic polyamide materials are, for example, polyamide-6, polyamide-6.6 or polyamide-6.10.

Furthermore, this process is suitable also for mixed fabrics, such as, for example, those from polyamide/cotton and polyamide/viscose.

The process according to the invention can be used for finishing polyamide material in the most varied forms, such as, e.g. woven or knitted textile materials, felts and, in particular, continuous webs.

The treatment according to the invention comprises a process in which the synthetic polyamide material is firstly dry cleaned either in a solvent or in an emulsion, and, optionally, shrunk; the solvents used are non-polar organic solvents, i.e. those which are not miscible with water or miscible therewith only to a limited degree, such as hydrocarbons, e.g. heavy benzine, or optionally halogenated aromatic hydrocarbons, such as chlorobenzene, or preferably halogenated aliphatic hydrocarbons, such as 1,1,1-trichloroethane, 1,1,2-trichloro-2,2,1-trifluoroethane, carbon tetrachloride, tri- or tetrachloroethylene or dibromoethylene. If an addition is made to these hydrophobic organic solvents of a small amount of water, about 0.05 to 2 percent by weight, with use of an emulsifier (= scouring intensifier) for water-in-perchloroethylene emulsions, then an emulsion is obtained which can also be used. Optionally, the dry cleaning process can be performed also at elevated temperature in order to facilitate shrinking of the fiber material. There is applied directly to the material preliminarily prepared in this manner, preferably after the material has been subjected to suction, wet-in-wet, i.e. without intermediate drying, at least one ionic optical brightener from a solution, emulsion or dispersion, for example, by lick rolling or padding, whereby the liquor of this optical brightener consists of one or more of the above-mentioned hydrophobic organic solvents, preferably perchloroethylene.

For the purpose of ease in handling, it is advantageous, particularly when the optical brighteners are applied from an emulsion, to use them in the form of brightener preparations. These contain small amounts of organosoluble surfactants, organic solvents, extenders and, optionally, also small amounts of water.

Furthermore, an addition of ionic auxiliaries to the treatment liquors or to the acid bath has in some case proved to be advantageous. Suitable ionic auxiliaries are, in particular, the known interface-active sulphosuccinic acid esters of the formula

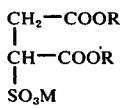

wherein R represents an alkyl radical having 3 to 16, preferably 6, carbon atoms, and M represents an alkali metal radical or amine radical, as well as mixtures thereof; the auxiliaries are used in an amount of 0.5 to 15 g, preferably 1.0 to 5 g, per liter of liquor. These auxiliaries can optionally be used in conjunction with additives of nonionic ethylene oxide adducts for stabilisation of the emulsions; these additives can amount to at most 30%, relative to the sulphosuccinic acid ester. Instead of the auxiliaries being added directly to the treatment liquors, they can with advantage also be used to form a paste with the optical brighteners, and can be added in this manner, in the form of a brightener/auxiliary agent paste, to the liquors.

The ionic optical brighteners usable according to the invention can belong to the most varied chemical classes. By ionic optical brighteners are meant, e.g. anionic brighteners such as substitution products of sulphonic acid and carboxylic acid, or cationic brighteners such as oxacyanines and quaternisation products. They are, for example, derivatives of the following types of compounds: 4,4'-diaminostilbene-2,2'-disulphonic acid (preferably bistriazinyl derivatives and bis-v-triazolyl derivatives); 1,4-distyrylbenzene; 4,4'-distyrylbiphenyl; benzidine; benzoxazoles; benzimidazoles; 1,3,4-oxdiazoles; diphenylimidazolone; 4- or 4,5-substituted 1,8-naphthalic acid imides; coumarin, 3-phenylcoumarin, etc.; pyrazoline, 1,3-diphenylpyrazoline, etc.; benzofuran; oxacyanines; pyrene; and 4-styryl-4'-(1,2,3-pyrazol-4-yl-ethenyl)-biphenyl.

The ionic optical brighteners can be used not only in the form of their inorganic salts, but also in the form of organic salts, e.g. anionic optical brighteners as amine salts, isothiuronium salts, etc., and cationic optical brighteners as fatty acid salts.

The amounts in which the optical brighteners are added to the application bath can vary depending on the degree of optical brightening desired; in general, amounts of about 0.05 to 5 g/l of liquor have proved satisfactory.

It is also possible, however, to apply the optical brighteners to the polyamide textile material not wet-in-wet in the preferred single-stage process but dry-in-wet, i.e. the optical brightener is applied to the dry, previously scoured polyamide material.

The synthetic polyamide material treated either wet-in-wet or dry-in-wet with the optical brightener is subsequently dried. In general, depending on the dryer and article, drying is carried out at a temperature of 60° to 120° C for 20 to 60 seconds.

The treatment of the dried material with the hot acid bath can be performed, e.g. as follows. The polyamide material is firstly passed through the hot bath, e.g. by impregnation on a padding machine, or the liquor is applied to the material by lick rolling or by spraying, e.g. with the use of a nip-padder, which is particularly advantageous because this operates cumulatively, and hence there is the possibility of offering the aqueous acid solution in "dosed" amounts. This process also provides the possibility of operating on short stretching frames; consequently, the drying costs can be further reduced.

If the application of the acid bath is effected by padding, then the fiber material is passed continuously through the hot liquor, and afterwards squeezed out or subjected to suction to give the desired content of impregnating solution of about 30 to 150 percent by weight, relative to the dry weight of the material.

The impregnated fiber material, optionally after preliminary drying, advantageously in a hot steam of air at about 40° to 80° C, is subsequently thermofixed by a heat treatment, for example, at a temperature of between 150° and 190° C, with treatment times of 60 to 20 seconds. Suitable for this purpose are: application of heat by contact, a treatment with high-frequency alternating currents, irradiation with infra-red or a treatment in a hot current of air.

Acids suitable for the process according to the invention are, in particular, organic acids, such as, e.g. lower aliphatic carboxylic acids, such as formic acid or acetic acid.

The bath has a pH-value of 2.0 to 5, preferably 3 to 5. For example, with the addition per liter of 1 to 3 ml of acetic acid (60%), pH-values of 4.5 to 5 are obtained, and with the addition per liter of 2.5 to 10 ml of formic acid (85%), acid (85%), pH-value of 3 to 4 are obtained.

Since ionic brighteners are preferably applied from emulsion systems, the surfactant that has remained on the material serves in the case of the acid bath simultaneously as wetting agent, so that the acid shock-treatment can be performed without addition of wetting agent.

The acid bath is maintained at temperatures of between 60° and 100° C, preferably higher than 75° C. Temperatures of between 80° and 90° C are particularly advantageous.

The durations or action times of the hot acid bath are short; in general, times of 5 to 60, preferably 5 to 10, seconds are required.

An addition of polyethylene glycols, e.g. polyethylene glycol 400 to 600, to the acid bath can be advantageous for the development of effects.

There is obtained on synthetic polyamide material by the process according to the invention an excellent white effect. The brightenings are moreover very level and have good fastness properties, e.g. fastness to dry cleaning and to washing.

The following examples serve to illustrate the invention without limiting its scope. Temperatures are given in degrees Centigrade; parts signify parts by weight.

EXAMPLE 1

A tricot made from textured polyamide-6.6 (Helanca), preliminarily scoured in perchloroethylene, is padded, while still moist with solvent (perchloroethylene content about 85%), with a liquor at room temperature, which liquor is prepared as follows:

6 g of the sodium salt of 2-di-(ethylhexyl)-sulphosuccinate and 1 g of the adduct of 1 mole of a fatty alcohol mixture having 11 to 18 carbon atoms and 18 mols of ethylene oxide are dissolved with stirring in 1 liter of perchloroethylene; and in this solution there is then emulsified 10 g of a solution of 1.5 g of the optical brightener of the formula

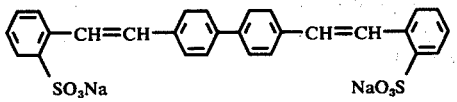

in a mixture of 60 parts by weight of ethylene glycol and 20 parts by weight of polyethylene glycol (molweight 300) and 20 parts by weight of water.

The squeezing effect on the tricot is subsequently 130%, calculated on the dry weight of the fiber material; the tricot is then dried at about 100°.

The dried material is halved. Half A is heat treated at 170° for 30 seconds in a stretching frame (e.g. in a laboratory stretching frame of the firm Mathis).

Half B is immersed for about 5 seconds in an aqueous liquor at 90° containing per liter 5 ml of 85% formic acid. The material is immediately afterwards squeezed out (about 105%), and is then dried and heat treated at 170° for 45 seconds in a stretching frame.

The two tricot samples have the following degrees of whiteness:

| | Fluorescence number* | Ciba-Geigy level of whiteness** |
|---|---|---|
| Sample A | 206 | 150 |
| Sample B | 289 | 226 |
| Untreated material | — | 56 |

*(measured with the Harrison Fluorimeter Model EE-100 B; manufacturer: Engineering Equipment Co., Boynton Beach, Fla. USA)
**(see: CIBA-GEIGY review 1973/1, pp. 10–25)

Whilst Sample A has only a meagre degree of whiteness, the degree of whiteness of Sample B is excellent.

EXAMPLE 2

The procedure is performed as in Example 1 B, with however the application liquor being obtained by the emulsifying of a solution of 1.5 g of the optical brightener of the formula

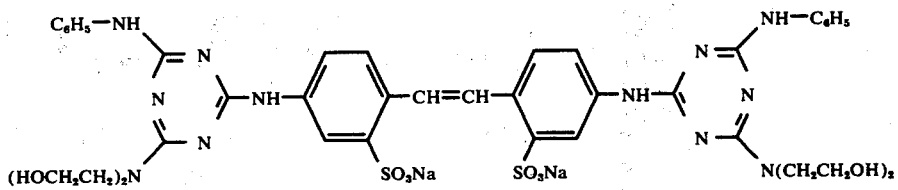

in 20 ml of water into the surfactant-containing liquor described in Example 1.

The acid-shock treatment is performed by immersion of the dried material for about 5 seconds in a liquor at 90° containing per liter 5 ml of 60% acetic acid. The material is immediately afterwards squeezed out and dried and heat treated at 170° for 45 seconds in a stretching frame. There is obtained an excellent, fully developed brightening on the polyamide material.

EXAMPLES 3 TO 5

If, instead of the optical brightener according to Example 2, there are used identical amounts of an optical brightener of the formulae

| Example No. | Optical brightener |
|---|---|
| 3 | 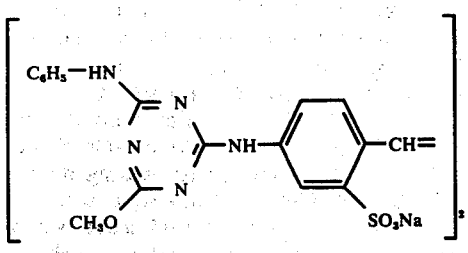 |

-continued

| Example No. | Optical brightener |
|---|---|
| 4 | 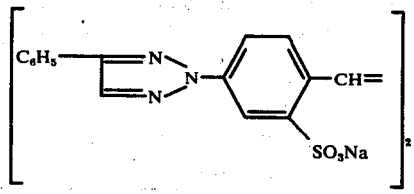 |
| | or the corresponding potassium salt, or |
| 5 | 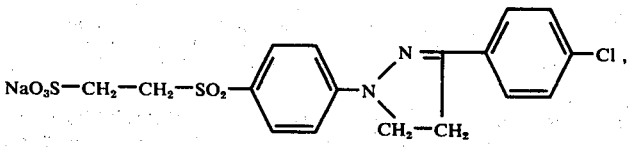 |

the procedure being as given in Example 2, then there are obtained on polyamide material likewise excellent, fully developed brightenings.

EXAMPLE 6

A knitted fabric made from polyamide-6.6 (nylon) which had been previously dry cleaned, is padded with

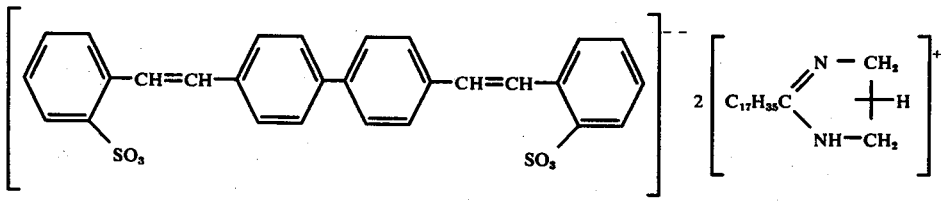

an organic liquor obtained by dissolving 2 g of the optical brightener of the formula

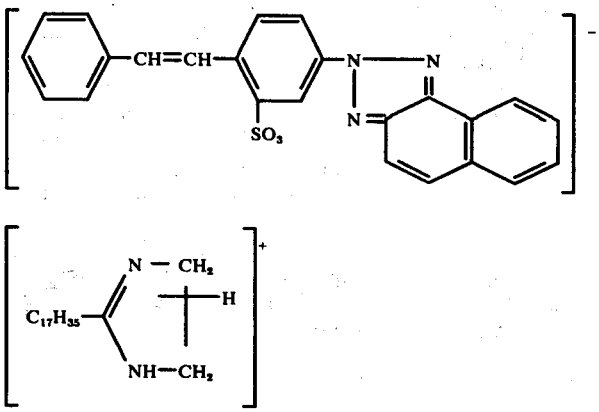

in 1 liter of perchloroethylene with subsequent filtration. The squeezing effect is 12.5%, calculated on the dry weight of the fiber. The perchloroethylene is afterwards removed by drying at 100°. The material impregnated in this manner is immersed for 7 seconds in an aqueous liquor at 90° containing per liter 5 ml of 80% acetic acid and per liter 1 g of the sodium salt of sulphosuccinic acid-2-ethylhexyl ester as wetting agent. The material is immediately afterwards squeezed out, and dried and thermofixed at 170° for 45 seconds in a thermofixing apparatus. A fully developed optical brightening having a high degree of whiteness is obtained.

EXAMPLE 7

If, instead of the optical brightener according to Example 6, identical amounts of an optical brightener of the formula are used, with otherwise the same procedure, then equally good optical brightening effects are obtained.

We claim:

1. Process for the continuous optical brightening of synthetic polyamide fiber material from organic solvents, wherein
   a. the fiber material is dry cleaned,
   b. at least one ionic optical brightener is applied to the material from a solution, emulsion or dispersion in a non-polar organic solvent,
   c. the material is dried,
   d. the optical brightener is treated with hot aqueous acid, and
   e. the fiber material is subsequently heat-treated.

2. Process according to claim 1, wherein formic acid or a lower aliphatic carboxylic acid is used to obtain an acid pH in the bath.

3. Process according to claim 2, wherein formic acid or acetic acid is used.

4. Process according to claim 1, wherein the acid bath has a pH-value of 2.5 to 5.

5. Process according to claim 4, wherein the acid bath has a pH-value of 3 to 5.

6. Process according to claim 1, wherein the treatment in the hot aqueous acid has a duration of 5 to 60 seconds.

7. Process according to claim 6, wherein the treatment in the acid bath has a duration of 5 to 10 seconds.

8. Process according to claim 1, wherein the acid bath has a temperature of 60° to 100°.

9. Process according to claim 8, wherein the acid bath has a temperature of 80° to 90° C.

10. Process according to claim 1, wherein after the material has been dry cleaned, the optical brightener is applied without intermediate drying employing the same organic solvent used for dry cleaning.

11. Process according to claim 1, wherein the non-polar solvent used is a halogenated aliphatic hydrocarbon, alone or as an emulsion with water.

12. A process according to claim 11 wherein the halogenated aliphatic hydrocarbon is perchloroethylene.

13. Process according to claim 1, wherein there are performed in a single stage dry cleaning of the polyamide fiber material from perchloroethylene and application of the optical brightener.

14. Process according to claim 1, wherein the optical brightener is applied from an emulsion.

* * * * *